US006036624A

United States Patent [19]

Cascini

[11] Patent Number: 6,036,624

[45] Date of Patent: Mar. 14, 2000

[54] PHYSICAL TRAINING APPARATUS, PARTICULARLY FOR THE TRAINING OF THE SHOULDER ROTATORS

[75] Inventor: Antonio Cascini, Vimercate, Italy

[73] Assignee: Technogym S.R.L., Gambettola, Italy

[21] Appl. No.: 09/012,646

[22] Filed: Jan. 23, 1998

[30] Foreign Application Priority Data

Jan. 24, 1997 [IT] Italy ..... MI97A0140

[51] Int. Cl.[7] ..... A63B 21/08; A63B 23/12

[52] U.S. Cl. ..... 482/97; 482/130; 482/136; 482/139; 482/908; 601/33

[58] Field of Search ..... 482/44, 46, 97, 482/135, 136, 137, 139, 905, 45, 98, 99, 100, 101, 121, 123, 127, 129, 130, 907, 908; 601/33

[56] References Cited

U.S. PATENT DOCUMENTS

| | | | |
|---|---|---|---|
| 684,688 | 10/1901 | Herz | 482/97 |
| 2,855,199 | 10/1958 | Noland et al. | 482/97 |
| 3,662,602 | 5/1972 | Weiss | 482/123 |
| 4,149,715 | 4/1979 | Kusmer | 482/128 |
| 4,405,128 | 9/1983 | McLaughlin et al. | 482/97 |
| 4,502,681 | 3/1985 | Blomqvist | 482/130 |
| 4,799,670 | 1/1989 | Williamson . | |
| 4,834,396 | 5/1989 | Schnell | 482/97 |
| 4,854,578 | 8/1989 | Fulks | 482/100 |
| 4,878,663 | 11/1989 | Luquette | 482/136 |
| 4,957,281 | 9/1990 | Christolear, Jr. | 482/137 |
| 4,989,861 | 2/1991 | Halpern | 482/97 |
| 5,102,121 | 4/1992 | Solow et al. | 482/137 |
| 5,344,374 | 9/1994 | Telle . | |
| 5,391,132 | 2/1995 | Greenwald | 482/91 |
| 5,603,681 | 2/1997 | Olschansky et al. | 482/129 |
| 5,785,635 | 7/1998 | Gerschefske et al. | 482/133 |

FOREIGN PATENT DOCUMENTS

| | | | |
|---|---|---|---|
| 0 368 591 | 5/1990 | European Pat. Off. . | |
| 0 617 986 | 10/1994 | European Pat. Off. . | |
| 115493 | 5/1918 | United Kingdom | 601/33 |
| WO 95/00210 | 1/1995 | WIPO . | |

*Primary Examiner*—Richard J. Apley
*Assistant Examiner*—Victor Hwang
*Attorney, Agent, or Firm*—Pillsbury Madison & Sutro LLP

[57] ABSTRACT

The invention relates to a physical training apparatus comprising a platform that mounts a column forming a surface which can rotate in a plane perpendicular to the column and on which a part of a user's body can be rested. The rest surface is connected to movement transmission means and these transmission means are in turn connected through a gear mechanism to load handling means. The gear mechanism is designed to convert the rotational movement of the rest surface performed by the user into a rotational movement of the load in a plane perpendicular to the platform, the rotational movement of the load being performed by muscular effort controlled by the user through the entire arc of the movement performed.

11 Claims, 4 Drawing Sheets

FIG. 7

PHYSICAL TRAINING APPARATUS, PARTICULARLY FOR THE TRAINING OF THE SHOULDER ROTATORS

BACKGROUND OF THE INVENTION

The present invention relates to a physical training apparatus, suitable in particular for strengthening the shoulder rotators and a work load handling device that can be adapted to exercise machines of different kinds. In particular, the invention relates to a physical training apparatus suitable for both rehabilitation and recreational purposes.

Physical exercise machines for training or rehabilitating the body or the body parts are being used more and more both in sports and in physical therapy. Indeed their use for therapeutic purposes in addition to purely recreational purposes is now widely accepted.

The vast range of conventional exercise machines currently available are designed for training different parts of the body with an adjustable load, usually consisting of plates made of cast iron or similar material, which can be stacked on one another and whose magnitude can be selected by the user in such a way as to create a desired work load.

The plates are connected to a chain or cable which is in turn connected to an element, such as a bar, handle, or similar handgrip designed to enable the user to lift and lower the plates in a vertical direction.

The system for creating the work load just described is the one most commonly used but, alternatively, it can be substituted by elastic belts of appropriate resistance designed to offer resistance to the moving of a mechanical part of the exercise machine, thereby applying a work load on the muscles of the user performing the movement.

Both techniques just described used to create the work load have certain disadvantages. For example, that the resistance offered by the load (plates or elastic belts) is applied during the positive component of a given movement when the user lifts the load, by muscular contraction or tension to exert physical force and hence exercise the muscles directly concerned.

However, during the negative component of the movement, when muscular contraction is relaxed and the load returns to its initial position by gravity, muscular work is reduced to accompanying the downward movement of the load, with the muscles extended instead of contracted.

In these machines, the gravitational nature of the load provided by the plates made of cast iron or similar material, forces the user to perform exercises in which the muscular effort applied to the user interface part is eccentric during the first part of the going stroke, (in the sense that its direction is opposite to that of the action of the load), and remains such until the end of the going stroke. On the other hand the muscular effort is concentric during the entire return stroke, that is, its direction is the same as that of the load. The working characteristic just described greatly reduces the utility of these machines for users that are patients whose joints only permit very limited angular movements and must be restored to their normal condition. In these cases, the load should cause eccentric and concentric effort alternately during the same stroke (going and/or return stroke) of the user interface part. Since gravity-loaded exercise machines capable of causing an effort of this kind are unavailable, patients frequently require the services of a physical therapist. Therefore, the success of the rehabilitation treatment is closely connected with the skill of the physical therapist.

In addition, if the patient to be rehabilitated is very heavily-built, the muscular strength required of the physical therapist may be more than the physical therapist's strength and this is obviously not acceptable in principle. Therefore, the exercise is effective mainly in the first part of the movement since the return movement requires less effort.

The present invention relates in particular to an apparatus for training the shoulder rotators, which are often injured in accidents.

Of the exercise machines of the kind described above, there is none that is especially designed for training the rotators and that is capable of guaranteeing a muscular effort that the user can adjust through the entire arc of the movement, nor can machines for strengthening the shoulder muscles in general (deltoids and similar muscles) be easily adapted to create loads that permit exercising of the rotators.

An aim of the present invention is to permit a user with a joint to be rehabilitated to recover its proper functioning by the use of an apparatus that is intrinsically safe—because it is based on simple mechanical principles and, therefore, based on a gravity type load—but that offers the user (whether to be rehabilitated or not) the possibility of exercising the muscles by alternating concentric and eccentric effort during a single stroke of the user interface that interacts with the load.

The present invention therefore has for its main object to provide an apparatus for training the shoulder rotators both for therapeutic and sports purposes.

In the context of this object, an aim of the present invention is to provide an apparatus for training the shoulder rotators that enables these muscles to work effectively through the entire arc of the movement performed.

Another aim of the present invention is to provide an apparatus for training the shoulder rotators that is suitable for users of different builds.

Another aim of the present invention is to provide an apparatus for training the shoulder rotators where the load can be adjusted at will according to requirements. Another aim of the present invention is to provide an apparatus for training the shoulder rotators that makes it possible to select the extent of the movement.

A further aim of the present invention is to provide a device for handling a load that can exert on the muscles that perform the movement an effort which the user can control through the entire arc of the movement and that can be adapted for exercise machines suitable for training any part of the body.

Yet another aim of the present invention is to provide a training apparatus that is highly reliable, relatively simple in construction and can be made at a competitive cost.

SUMMARY OF THE INVENTION

The present invention provides a physical training apparatus comprising a platform; a column mounted on the platform; the column being delimited at the top by a tubular element which in turn mounts a user interface part in such a way that the latter can rotate freely about a first given axis starting from a fixed position; a load unit being supported by the platform and being connected, through a mechanical transmission device, to the user interface part in such a way that it can be actuated for training purposes by a user operating on the user interface using a part of the body that has at least one joint; the apparatus being characterized in that the load unit comprises a pendulum that rotates about a second, horizontal axis through an angle of defined amplitude relative to a first angular reference between a first and a second rest position; the pendulum being designed to apply a load whose value varies according to the variation of its angular position relative to the first and second positions.

The purpose and aims described above are also achieved by a load handling device especially designed for physical training machines and comprising means for the transmission of motion that can be operated indirectly by the user and a gear mechanism designed to transmit to the load the movement applied indirectly by the user to the motion transmission means, the device being characterized in that the gear mechanism is designed to convert a movement applied by the user into a rotational movement of the load, the rotational movement being adjustable in amplitude in such a way as to regulate the intensity of the effort.

BRIEF DESCRIPTION OF THE DRAWINGS

Further characteristics and advantages of the apparatus made according to the present invention are more apparent from the description which follows with reference to the accompanying drawings which illustrate preferred embodiments of the invention.

DESCRIPTION OF THE PREFERRED EMBODIMENTS

Figure 1:
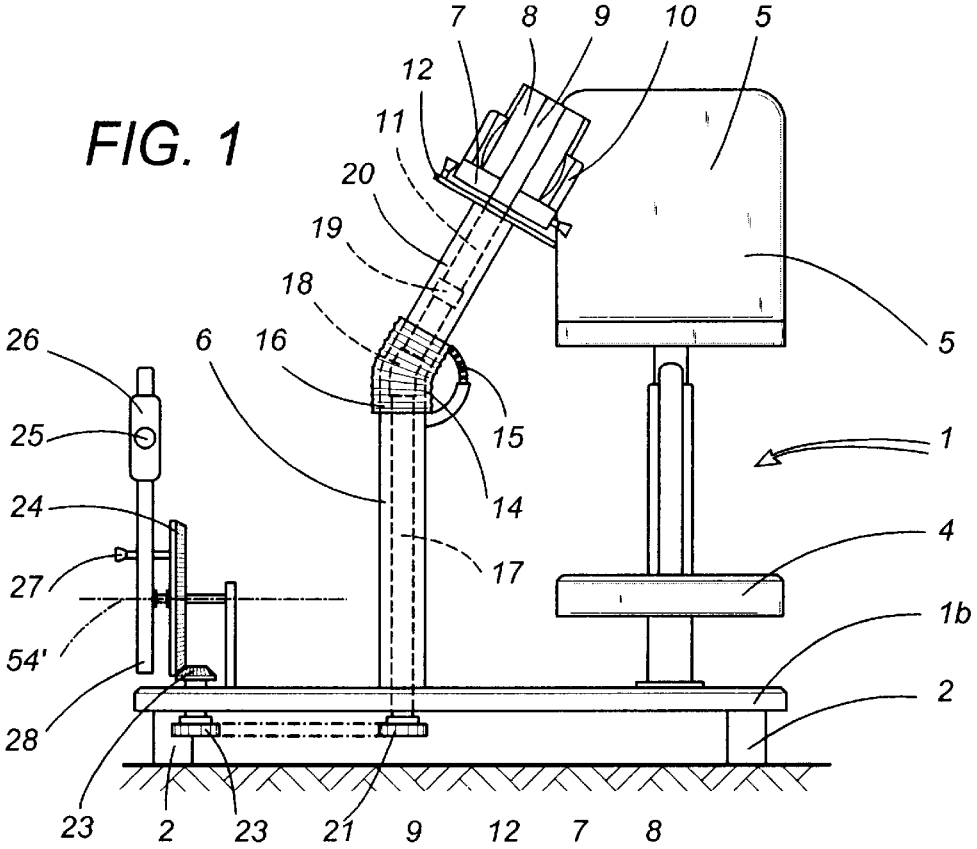
FIG. 1 is a front elevation view of the apparatus made in accordance with the present invention.

As seen in the accompanying drawings, the apparatus 1 made in accordance with the present invention comprises a square supporting platform 1*b* equipped with four feet 2 at the four corners.

The platform 1*b* mounts a swivel-seat 3, equipped with a footrest 4 and a reclining backrest 5. The seat 3 allows the user to perform the shoulder rotator strengthening exercise in a seated position.

Since the exercise can also be performed in a standing position, the seat 3 can slide sideways, parallel to the platform 1*b* and can thus be moved out of the way so that the user can stand on the platform 1*b*.

Next to the seat 3, there is a tubular supporting column 6 with a tablet 7 at the top of it, on which the user sitting on the seat 3 can rest his/her forearm. The tablet 7 has a supporting frame 8 in which the user can place his/her elbow and which acts as a support for the entire forearm.

At the end of the tablet 7 opposite where the forearm supporting frame 8 is located, there is a handgrip 9 designed to be held by the user to allow him/her to exert a force on the tablet 7 in such a way as to move it towards and away from his/her body and always about a first axis 54.

Behind the handgrip 9, there is a padded clamp 10 to provide further support for the user's wrist. The tablet 7 is integral with supporting means consisting of an arm 11 housed inside the tubular supporting column 6.

At the top of the tubular supporting column 6, there is a crown 12 controlling the angle of rotation of the tablet 7.

Figure 4:
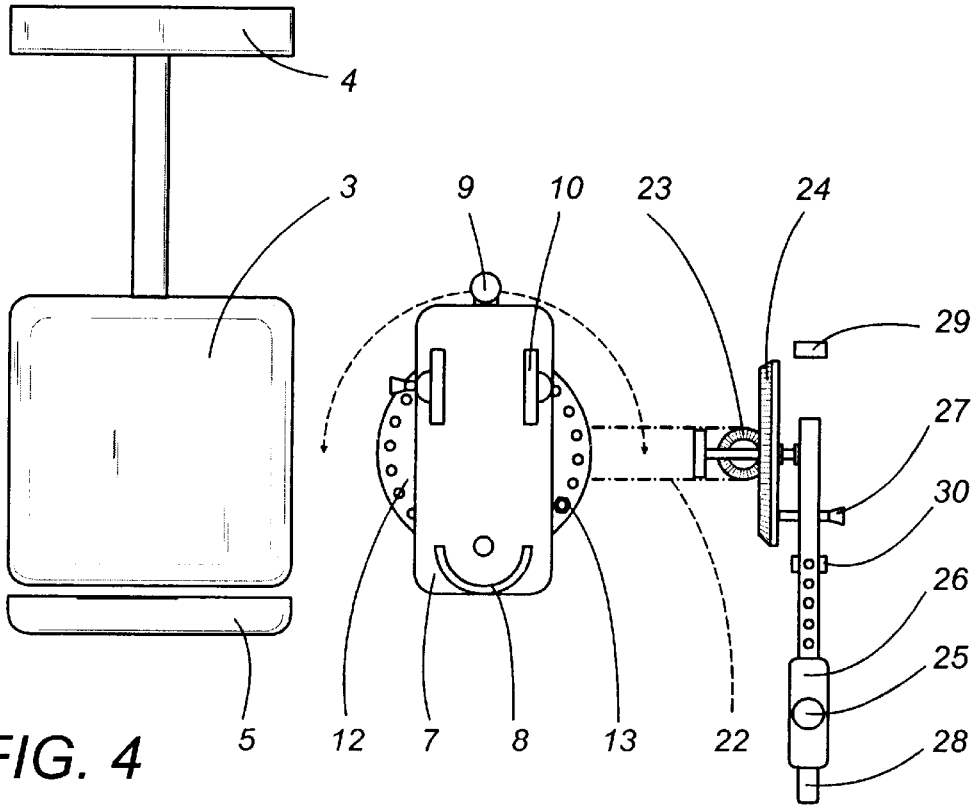
FIG. 4 is a top plan view of the apparatus made in accordance with the present invention, with the armrest parallel to the seat.
Figure 5:
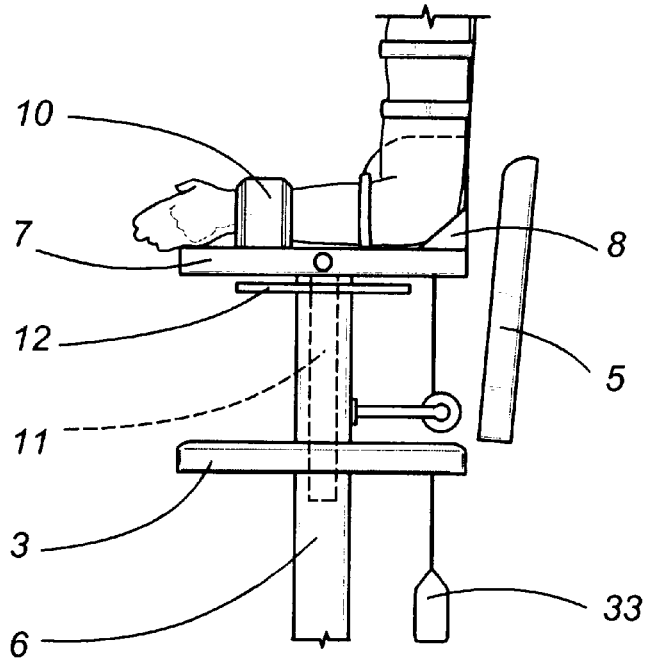
FIG. 5 is a side view of the armrest where a user's forearm is placed and to which an additional load is connected to keep the forearm in the correct position.

The crown 12 has a plurality of holes made around its circumference into which stop elements 13 (see FIG. 4) can be inserted to define the amplitude of the rotation that can be performed by the tablet 7 (and hence by the user's forearm) in relation to the crown 12. The supporting column 6 is divided into two halves connected to each other by an articulated joint consisting, for example, of a hinge 14 designed to allow the upper half (corresponding to the arm 11) to be set at an angle of approximately 45–90° with respect to the lower half (corresponding to a transmission shaft 17, as described below).

For this purpose, there are angle adjustment means 15 designed to permit setting of the arc through which the upper half column can rotate with respect to the lower half, in the plane perpendicular to the plane made by the platform 1*b*.

There is a concertina 16 placed around the hinge 14. The arm 11 ends with a universal joint 19 that engages with movement transmission means comprising a telescopic transmission joint 20 connected to another universal joint 18 which in turn engages with a transmission shaft 17.

Therefore, the transmission shaft 17 receives motion from the tablet 7.

The telescopic transmission joint 20 enables the rotational motion of the tablet 7 to be transmitted even when the tablet is at an angle to an axis normal to the platform 1*b*.

The transmission shaft 17 is in turn connected to a gear mechanism designed to convert the rotational motion of the tablet 7, in a plane again perpendicular to the plane in which the arm 11 lies, into a different type of motion described in more detail below. The gear mechanism consists of a chain, sprocket and crown gear.

Looking in more detail, the transmission shaft 17 ends with a first sprocket 21 that meshes with the chain 22 which is in turn meshed at its other end with a second motion transfer sprocket 23.

The transfer sprocket 23 in turn meshes with a transmission disc or crown 24 which rotates about a second, horizontal axis 54' and whose surface is not only toothed around its circumference but also has a plurality of circumferential holes.

The transmission disc 24 is perpendicular to the sprocket 23 and to the platform 1*b*.

Figure 2:
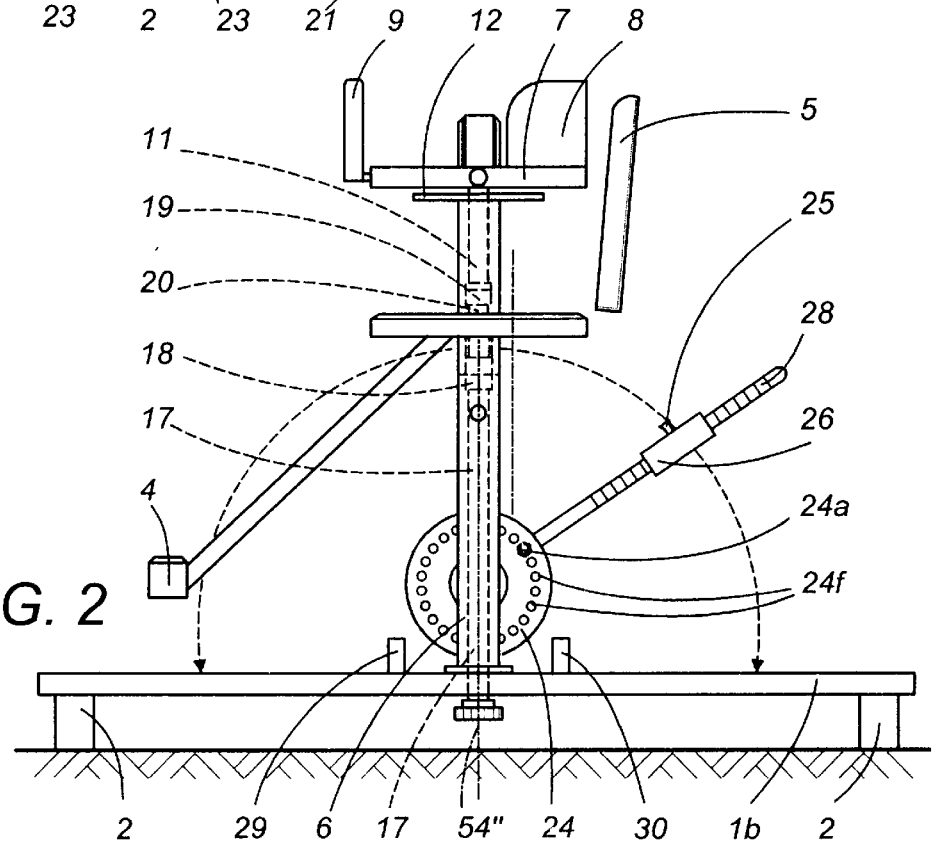
FIG. 2 is side elevation view of the apparatus in accordance with the present invention illustrated in FIG. 1.
Figure 3:
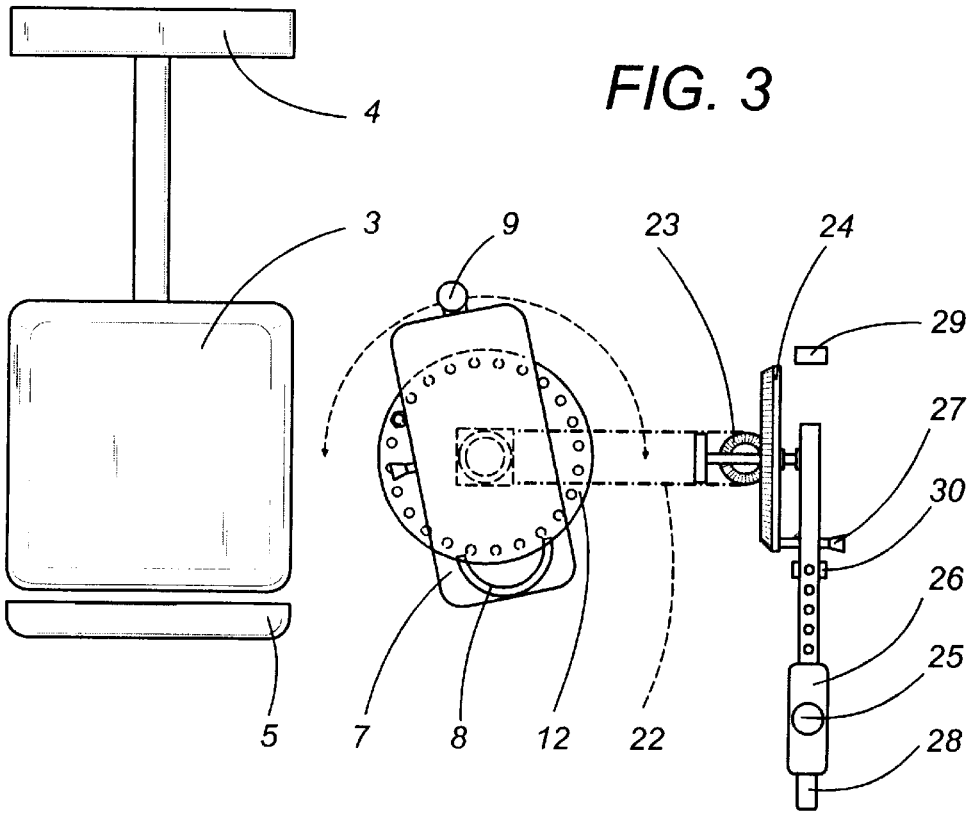
FIG. 3 is a top plan view of the apparatus made in accordance with the present invention, with the armrest at an angle to the seat.
Figure 6:
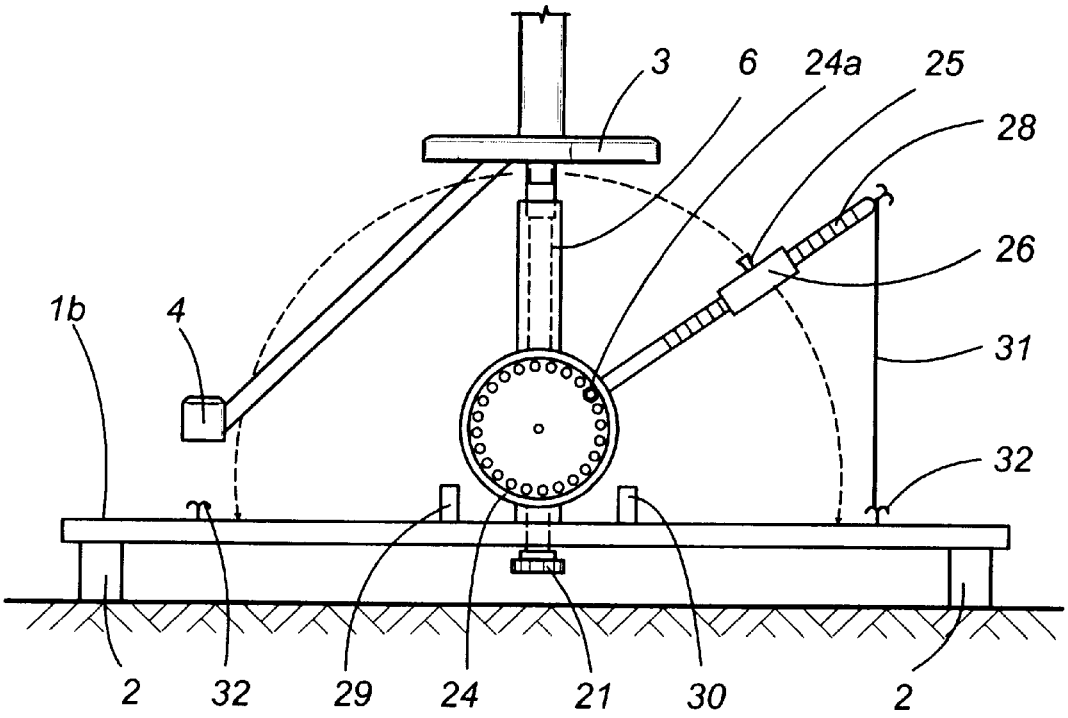
FIG. 6 is a side elevation view of a second embodiment of the apparatus made in accordance with the present invention.

A bar 28, equipped with a sliding weight 26, stopped by a clamp 25, can be connected to the transmission disc 24 by inserting a stop pin 27 into one (number 24*a* in FIGS. 2 and 6) of the plurality of circumferential holes 24*f* made in the transmission disc 24.

The bar 28 is graduated so that the user can set the weight 26 at well-defined positions along it. In this way, the position of the weight 26 along the bar 28 and the position of the bar itself in relation to the transmission disc 24 determine the load actually moved by the user by rotating the tablet 7.

Next to the transmission disc 24 and attached to the platform 1*b*, there is a pair of end stop elements 29 and 30 against which the bar stops when it comes to the end of its stroke. As can be seen, therefore, the maximum arc through which the bar can move is 180°.

Obviously, the transmission disc 24 can be placed higher above the platform 1*b* than is illustrated in the drawings, in which case the bar could move through as much as 360°.

The gear mechanism, therefore, converts the rotational movement of the tablet 7 in the plane perpendicular to the plane in which the arm 11 lies into a rotational movement in the plane perpendicular to the platform 1*b*.

By choosing the position at which the bar 28 is stopped, it is possible to determine the load that the user moves by rotating the tablet 7.

The transmission ratio between the disc 24 and the transfer sprocket 23 is such that moving the rod 28 always requires the same muscular effort of the muscles performing the exercise (in this case, the shoulder rotators).

Thus, during the positive position of the movement, that is to say, when the user rotates the tablet 7 outwards by moving his/her forearm away from the body, the bar 28 turns through a first section starting from an initial position chosen by connecting the bar 28 to the transmission disc 24 to an end position.

When the user moves his/her forearm back towards the body by turning the tablet 7 inwards, the transmission disc 24 reverses its direction of rotation and returns to the initial position, not by gravity but by muscular effort, exerted this time by the muscles antagonistic to those used for the first part of the movement.

Obviously, the muscular effort will be directly correlated to the position of the bar 28 relative to the transmission disc 24. Thus, if the user wishes to make an easy movement, the initial position should be set close to the middle dead center (bar vertical), labeled 54".

The transmission ratio between the disc 24 and the sprocket 23 is high and prevents the part that is normally negative (i.e., the return of the weight by gravity) from continuing to be positive.

If the user wishes to work with light weight loads, for rehabilitation purposes, for example, it is sufficient to work with the bar 28 set almost perpendicular to the platform 1*b* since, in this position, the first part of the movement is effected with a light weight load, while the load increases as the bar 28 moves away from the vertical dead center.

The possibility of adjusting the angle of the supporting arm 11 relative to the axis normal to the platform 1*b* and thus to make the shoulder rotator muscles work at different angles means that there is a wide range of muscular exercises to choose from.

Moreover, the load that the user must move can be changed (increased) by using an elastic belt 31 to connect the free end of the bar 28 to a hook 32 on the platform 1*b*.

In an alternative embodiment (not illustrated) the load can be created solely by the elastic belt 31 and the weight 26 can be dispensed with altogether.

In order to pull the user's humerus axially while keeping it firmly secured in the supporting frame 8, there is a weight 33 designed to be secured to the forearm to keep the latter as still as possible so that the rotational movement of the tablet 7 is effected by the shoulder rotators only, without using other muscles which might alleviate the effort exerted by the rotators and which would thus diminish the effectiveness of the exercise.

Instead of the pulling weight 33, there may be an adjustable retaining spring (not illustrated in the drawings) to allow the pulling force on the humerus, keeping the forearm against the tablet 7, to be adjusted.

In practice, it has been found that the apparatus made in accordance with the present invention fully achieves its purpose because it strengthens the shoulder rotators by allowing user-controlled muscular effort through the entire arc of the movement performed.

In particular, the apparatus made in accordance with the present invention permits movements with a desired load and whose angle and amplitude can be chosen according to the user's requirements.

The load handling device used in the apparatus disclosed by the present invention can also be applied to exercise machines for training muscles other than the shoulder rotators.

The device can be used to provide the maximum efficiency in muscle training since the intensity of the effort exerted (contraction) is equal during both the active stage of the movement and the stage that would normally be passive (but that remains active due to the features of the present invention).

The apparatus disclosed by the present invention can be subject to modifications and variations without thereby departing from the scope of the inventive concept. Moreover, all the details of the invention may be substituted by technically equivalent elements.

Figure 8:
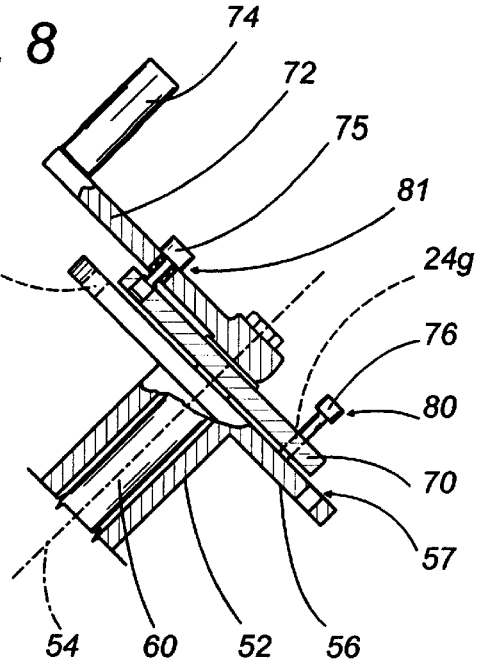
FIG. 8 is a sectioned, longitudinal plane view along the line VIII—VIII of FIG. 7.
Figure 8:
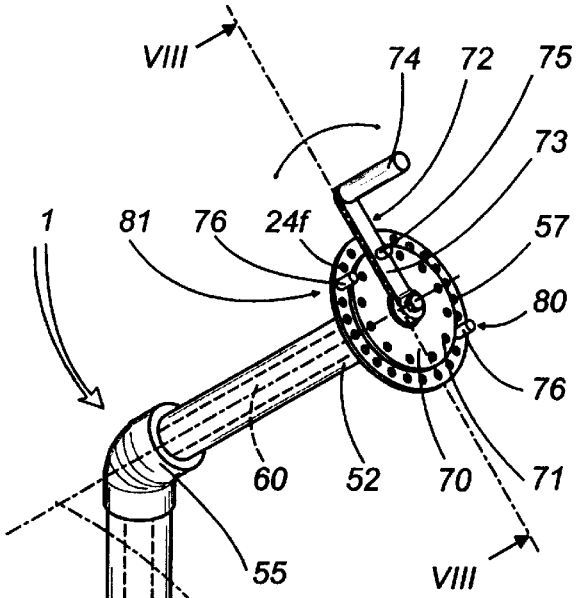
Figure 7:
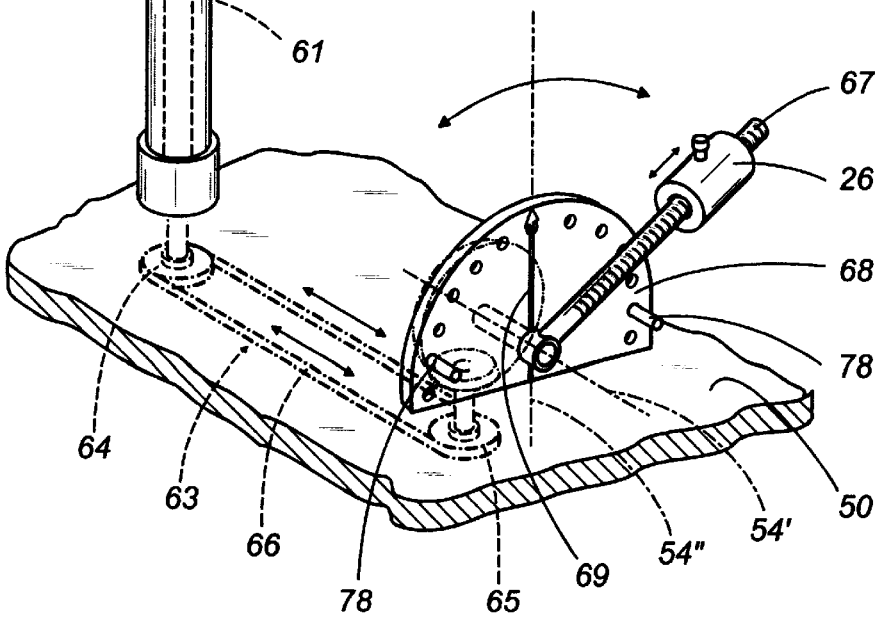
FIG. 7 is a scaled-up perspective view and with parts cut away to better illustrate others of a third preferred embodiment of the apparatus illustrated in FIG. 1.

For example, in FIGS. 7 and 8, the apparatus 1 can be modified to make it suitable for use for rehabilitation purposes, not necessarily restricted to the rehabilitation of the rotators of the shoulder but in general to the rotators of any joint in the body. In particular, the apparatus 1 comprises a platform 50, essentially the same as the platform 1*b*, and mounting a vertical column 51. At the top end of the column 51 there is a tubular element 52 whose axis 54 can be angled at will because of an articulated joint 55 by which the column 51 and the element 52 are connected.

In FIG. 8 in particular, the element 52 ends with a circular flange or disc 56 equipped with a crown 57 of holes 24*f* parallel to the axis 54. The element 52 houses a shaft 60 that is axially fixed but free to turn, while the column 51 houses a shaft 61 that is also axially fixed but free to turn. For simplicity, in FIG. 7, the two shafts 60 and 61 are only partially illustrated and are shown by a dashed line. The two shafts 60 and 61 are connected to each other at an angle by a customary ball joint, which is not illustrated. The platform 50, like the platform 1*b*, mounts an assembly 63 for the transmission of rotational motion and consisting of the sprockets 64 and 65 and the chain 66, whose function is the same as that performed by the assembly made by the sprockets 21 and 23 and the chain 22. As in FIG. 1, the apparatus 1 comprises a bar 67 that is essentially the same as the bar 28. Since the motion of the bar 67 is similar to the motion of an upside down pendulum, the bar 67 will hereinafter also be referred to as pendulum 67. The platform 50 mounts a graduated sector, which in FIG. 7 has an amplitude of 180° but the amplitude can be smaller or larger depending on the angle that is to be swept by the pendulum 67. The sector 68 has a central portion equipped with a pointer 69 which divides the angle swept by the pendulum 67 in half.

Again in FIG. 8, the shaft 60 is equipped with a flange 70 that delimits it at the top and is made from one piece. The flange is coaxial with the disc 56 and has a crown 71 of concentric holes 24*g* parallel to the axis 54. The flange 70 is raised with respect to the disc 56 so that it can turn freely relative to the latter. The flange 70 acts as a support for a user interface part designed to be actuated by a part of the body of a person using the apparatus 1. In FIG. 7, the interface part is a crank 72 with an elongated body 73 and a handgrip 74. In particular, the crank 72 can be disconnected from the shaft 60 so that the angular position of the crank 72 relative to the flange 70 can be adjusted to the user's requirements. To permit adjustment, the crank 72 has a spring pin 75 on the elongated body 73 at the crown of holes 71.

The amplitude of the movement of the crank 72 can be adjusted on the disc 56 through a pair of pins 76, each of which is designed to engage one of the holes 24*f* in the crown 57 and to act as an end stop. The amplitude of the movement of the pendulum 67 can be adjusted using two end stops 78 mounted on opposite sides of the pointer 69 on the sector 68.

The combination of the disc 56 and the corresponding crown of holes 57 and pins 76, the shafts 60 and 61, and the transmission assembly 63 forms a device 80 for adjusting the two end stop positions of the pendulum 67 on opposite sides of the pointer 69.

Therefore, once the position of the weight 26 along the body of the pendulum 67 has been fixed, the device 80 makes it possible to control the maximum load generated by an eccentric effort on the user and the maximum load generated by an concentric effort on the user.

In addition, the combination of the flange 70 and the holes in the crown 71 and the pin 75, the shafts 60 and 61, and the transmission assembly 63 forms a device 81 for adjusting the angle of rotation of the crank 72 to be associated with the zero load provided by the neutral position of the pendulum 67, that is to say, the position in which the pendulum is parallel to the pointer 69. In other terms, the device 81 is used to adjust the crank angle at which the user's effort changes from eccentric to concentric and vice versa.

In yet another embodiment of the apparatus 1, based on that described in FIG. 7, it is possible to connect the pendulum 67 with a control device that has an electromagnetic actuator (not illustrated). In this way, the load variation can be adjusted according to profiles defined by the user on the basis of his/her own training or rehabilitation requirements.

In practice, the present invention can be embodied with any materials, provided they are compatible with the specific use, and in any size, according to requirements and to the state of the art.

What is claimed is:

1. A physical training apparatus comprising:

a platform;

a column having a lower end mounted on the platform and an upper end including a mounting element;

a user interface part mounted on the mounting element for being actuated by a user body part that has at least one joint, the user interface part being freely rotatable about a first given axis starting from a fixed position;

a load unit supported by the platforms; and a mechanical transmission device connecting the load unit to the user interface part, the mechanical transmission device constructed and arranged to permit the load unit to be actuated by the user interface part, wherein the load unit comprises a pendulum rotatable about a second axis between distinct first and second end stops, locations of the first and second end stops being adjustable and the second axis being horizontal axis;

wherein an amplitude of the rotational angle of the pendulum is determined by the user's selection of the locations of the first and second end stops;

wherein the pendulum comprises a lever arm which applies a load to said transmission device whose value varies according to the variation of an angular position of the pendulum relative to the first and second end stops; and wherein the mounting element at the upper end of the column comprises:

first adjustment means constructed and arranged to control an amplitude of the rotation of the user interface part; and second adjustment means constructed and arranged to vary a fixed position of the user interface part at which the user can associate with a zero load provided by the pendulum at which the load changes from relatively positive to relatively negative and vice versa as the pendulum rotates between the first and second end stops.

2. The apparatus according to claim 1 wherein the first and second end stop positions are located opposite to each other with respect to a first angular reference, so that the load has the value zero when the pendulum is parallel to the first reference; the load requiring the user to apply an eccentric and concentric effort alternately.

3. The apparatus according to claim 1 wherein the pendulum comprises:

a weight mounted on the lever arm, the weight axially slidable along the lever arm to a fixed position selected by the user, wherein the location of the fixed position of the weight along the lever arm varies the gravitational load felt by the user.

4. The apparatus according to claim 3 wherein the first adjustment means comprises:

a disc mounted on the mounting element and located in a position below the user interface part, the disc having at least one first crown of first holes parallel to the second transmission shaft and equidistantly spaced around the second transmission shaft in a circular arc, and a pair of first end stop pins which can be selectively inserted into the first holes in order to set the amplitude of rotation of the user interface part to a desired angle.

5. The apparatus according to claim 4 wherein the disc has a second crown of second holes parallel to the second transmission shaft and equidistantly spaced around the second transmission shaft in a circular arc; the user interface part being equipped with a pin designed to be inserted into one of the second holes in order to fix the angle at which the load changes from eccentric to concentric and vice versa.

6. The apparatus according to claim 1, wherein the load unit comprises resistance means that can be selectively connected to the pendulum and that are designed to fine tune the load according to user-defined profiles.

7. The apparatus according to claim 1 and further comprising a swivel-seat with a reclining backrest disposed on the platform, the seat being movable in a direction parallel to the platform.

8. The apparatus according to claim 7 wherein the seat is equipped with a footrest.

9. The apparatus according to claim 1 wherein the column comprises an upper portion and a lower portion, the lower portion being tubular and connected to the upper portion by an articulated joint; and wherein the mechanical transmission device comprises:

a first transmission shaft housed inside the lower portion, the first transmission shaft being axially fixed but freely rotatable angularly;

a second transmission shaft being housed inside the upper portion, the second transmission shaft being axially fixed but freely rotatable angularly; and a ball joint connecting the first and second transmission shafts, the ball joint constructed and arranged to permit transmission of a rotational motion between the first and second transmission shafts irrespective of the position of the upper portion relative to the lower portion.

10. The apparatus according to claim 9 wherein the mechanical transmission device also comprises a transmission unit located between the first transmission shaft and the pendulum, the transmission unit constructed and arranged to transmit a rotational motion between the first transmission shaft and the pendulum.

11. The apparatus according to claim 1 wherein the load unit comprises third adjustment means for adjusting the angle of rotation of the pendulum, the third adjustment means constructed and arranged to indicate a first stop end position.

* * * * *